US005494104A

United States Patent [19]

Sable, II

[11] Patent Number: 5,494,104

[45] Date of Patent: Feb. 27, 1996

[54] SNAP-ON ROD GUIDE

[75] Inventor: Donald E. Sable, II, Oklahoma City, Okla.

[73] Assignee: Enterra Patco Oilfield Products, Houston, Tex.

[21] Appl. No.: 272,414

[22] Filed: Jul. 8, 1994

[51] Int. Cl.[6] ..... E21B 17/10

[52] U.S. Cl. ..... 166/241.4

[58] Field of Search ..... 166/241.1, 241.2, 166/241.3, 241.4

[56] References Cited

U.S. PATENT DOCUMENTS

| | | | |
|---|---|---|---|
| 2,793,917 | 5/1957 | Ward | 166/241.4 |
| 3,414,337 | 12/1968 | Sable | 166/241.4 |
| 4,858,688 | 8/1989 | Edwards et al. . | |
| 4,938,285 | 7/1990 | Edwards et al. . | |
| 5,154,867 | 10/1992 | Edwards et al. . | |

*Primary Examiner*—Michael Powell Buiz
*Attorney, Agent, or Firm*—Gunn & Associates

[57] ABSTRACT

A field-installable rod guide firmly grasps the sucker rod to which it is attached and reduces fluid friction to axial movement of the rod guide. The rod guide includes one or more channels for fluid to flow by the guide through straight or helical vanes. An axial access channel which permits application of the rod guide onto a sucker rod has a wide, tapered mouth to minimize the length of time during which the guide is stretched during installation. Recognizing that some stretch is inevitable in the guide at the point opposite the axial access channel, more rod guide material is placed at this point of greater stretch. In a preferred embodiment of the present invention, the rod guide stock from which the rod guide is machined is extruded to form the desired vanes as well as a non-circular "rod hole." This way, a "dual-radius" hole is enabled. The dual-radius hole narrows the gripping radius of the guide to solidly grasp the rod and eliminate slipping of the guide on the rod.

9 Claims, 3 Drawing Sheets

Fig. 4
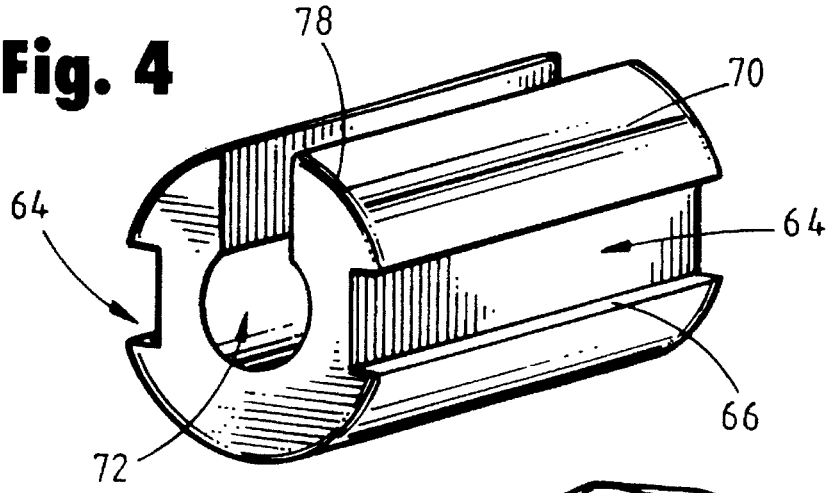
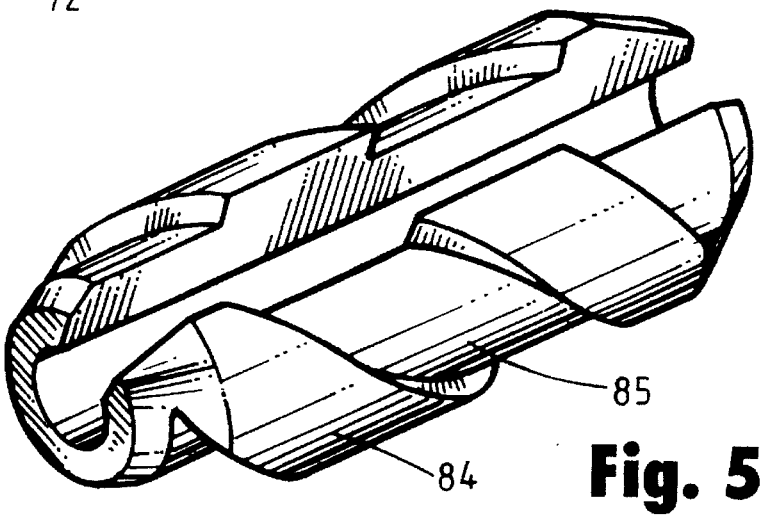
Fig. 5
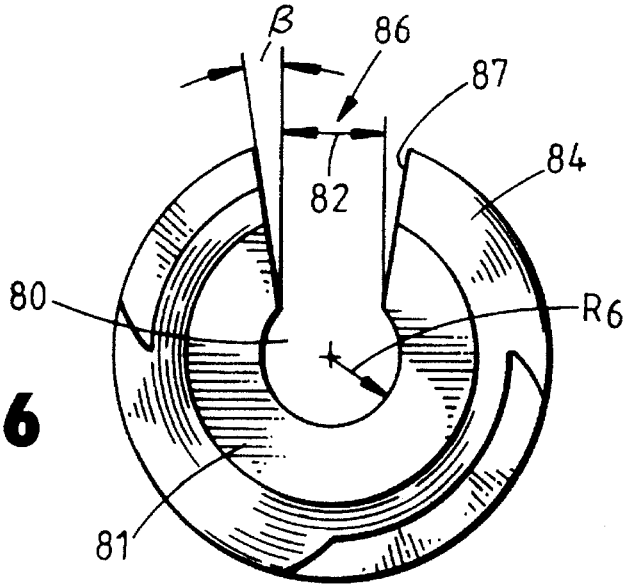
Fig. 6

SNAP-ON ROD GUIDE

FIELD OF THE INVENTION

The present invention relates generally to the field of field-installable rod guides and, more particularly, to a snap-on rod guide that more firmly grasps the sucker rod to which it is attached to remain in spaced relation to other rod guides.

BACKGROUND OF THE INVENTION

Rod guides for centralizing sucker rods within production tubing are known in the prior art. A pumping unit has attached thereto a sucker rod and the sucker rod is coupled at its bottom end to a reciprocating pump. As the pumping unit moves the sucker rod down, the barrel of the reciprocating pump fills with the production fluid to be produced. Conversely, as the pumping unit moves the sucker rod up, a valve in the reciprocating pump shuts and the production fluid in the pump barrel is lifted, displacing production fluid above it and forcing one pump-barrel's worth of production fluid out of the hole.

The sucker rod must extend from the pumping unit all the way down to the reciprocating pump, which may be several thousand feet below the surface. Consequently, the sucker rod is subjected to a variety of stresses: compression, tension, torsion, and bending. During reciprocation, the string of the sucker rod tends to contact the walls of the pipe which surrounds it, resulting in abrasion of the sucker rod and surrounding tubing. This is particularly prevalent in deviated holes where, without the use of rod guides, the sucker rod would continuously contact and abrade against the tubing.

In operation, the sucker rod is immersed in production fluid. As the sucker rod moves up and down to pump fluid from down hole, the rod guide develops resistance to the movement of the sucker rod due to hydraulic action of the fluid around the rod guide.

Some rod guides are molded in place on the sucker rod. The rod is laid across a mold half, the other mold half is placed on top of the rod, and the combination is injected with a polymeric fluid that solidifies into a molded rod guide. Other rod guides are made as a separate unit apart from and installed on the sucker rod, particularly in the field to replace worn guides. Such rod guides are often termed "field-installable" rod guides. These guides may be either injection molded, machined from a stock material, or extruded and machined to achieve the desired structure.

One prior art field-installable rod guide is made from an extruded, solid cylindrical stock. The stock comes in the form of a long, solid bar of long-chain polymeric material. The bar stock is cut to the length of the desired rod guide, a cylindrical hole is cut in the center of the cut bar stock to a radius slightly less than the rod to which the guide will be attached, an axial access channel is cut to provide access of the rod to the center-hole, and the ends of the guide are beveled to reduce fluid friction. The guide is then ready to be snapped or hammered onto a rod, either at the yard or in the field.

This known field-installable rod guide is simple to make and is relatively inexpensive. Since the guide is made of extruded material, the intended applications of such a rod guide are relatively low temperature and low stress. Unfortunately, polymeric compositions that are easily extruded are not generally well suited for high temperature, high pressure, and high stress applications. Further, these guides suffer from several additional drawbacks. The solid-cylindrical aspect of such a rod guide delivers unnecessarily high fluid resistance to pumping movement in both the up and down directions, despite the beveled ends of the guide. Also, the round hole in the center of the guide does not adequately grip the rod and, consequently, the guide tends to slip on the rod. If a guide slips enough, a number of guides may become bunched at one end of a rod segment. This means that a long segment of the rod has no rod guide along its length and the rod may ride against the casing, particularly where the hole is not straight. This defeats the purpose of the rod guide.

Another drawback of this known rod guide is in the structure of the axial access channel that is cut in the rod guide to allow the guide to be placed upon the rod. As the guide is placed on the rod, the sides of the channel are forced apart enough for the guide to slip on the rod. As the sides of the channel are stretched apart, the portion of the guide directly opposite the channel experiences the stretch and this portion of the guide may exceed the elastic limit of the material. If this happens, the guide remains stretched and loses much of its ability to grasp the rod. One proposed solution to this problem has been to cut a second channel, wider yet shallower than the first channel, so that only part of the channel depth offers the narrower opening. The deeper part of the channel offers more material around the rod but this proposed solution has proven only partly satisfactory since the narrow channel still stretches the rod material, often beyond its elastic limit.

Thus, there remains a need for a field-installable rod guide that is simple and inexpensive yet firmly grasps the rod to remain fixed in place during normal operations. Such a rod guide should permit more fluid to pass adjacent the rod guide during reciprocating movement to reduce fluid drag against the rod guide. The guide should also provide a structure that recognizes the problem of exceeding the elastic limit of the guide material during installation and make allowances for this phenomenon.

SUMMARY OF THE INVENTION

The present invention solves these and other problems of the prior art by providing a structure that begins with the basic prior art field-installable rod guide and is modified to address each of the aforementioned drawbacks. First, rather than presenting a solid cylindrical profile to the fluid flow around the rod guide, the present invention includes one or more channels for fluid to flow by the guide, by having straight or thread-type vanes. Next, the axial access channel has a wide, tapered mouth to minimize the length of time during which the guide is stretched during installation. Recognizing that some stretch is inevitable in the guide at the point opposite the axial access channel, more rod guide material is placed at this point of greater stretch. Finally, in a preferred embodiment of the present invention, the rod guide stock is extruded to form the desired vanes as well as a non-circular "rod hole." This way, a "dual-radius" hole is enabled. The dual-radius hole narrows the gripping radius of the guide to solidly grasp the rod and eliminate slipping of the guide on the rod.

These and other objects and features of the present invention will be apparent to those of skill in the art as they study the following detailed description along with the accompanying drawing figures.

BRIEF DESCRIPTION OF THE DRAWINGS

FIG. 4 is a three-dimensional view of the snap-on rod guide of the embodiment of FIG. 3.

FIG. 5 is a three-dimensional view of another embodiment of the snap-on rod guide of the present invention.

FIG. 6 is an end view of the embodiment of the rod guide of FIG. 5.

DETAILED DESCRIPTION OF PREFERRED EMBODIMENTS

Figure 7:
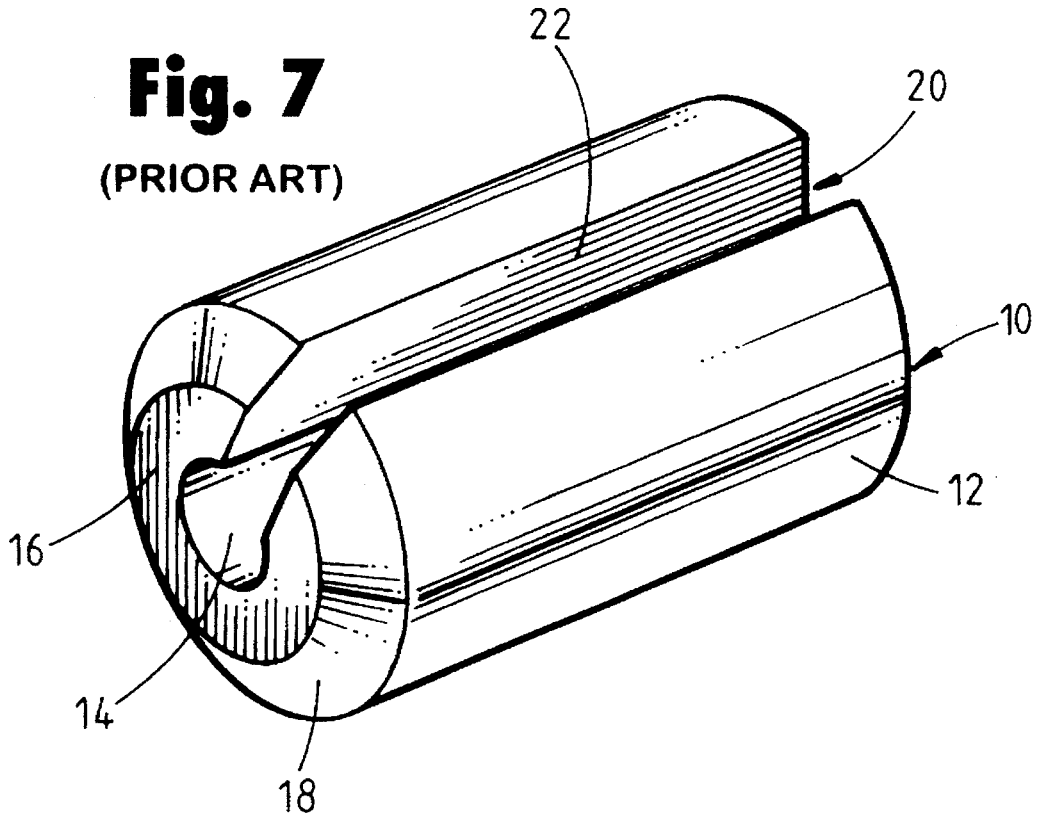
Fig. 7 (PRIOR ART)
FIG. 7 is a perspective view of a prior art rod guide.

FIG. 7 depicts a three-dimensional view of a prior art field-installable rod guide 10. The rod guide 10 includes an elongated cylindrical body 12 with a co-axial cylindrical hole 14. At each end of the guide 10 is a flat face 16 and a beveled surface 18. To allow access of a sucker rod into the center-hole 14, an axial access channel 20 is machined through the body 12 to the center-hole. The axial access channel 20 has generally parallel sides 22. When the rod guide is installed on a sucker rod, the sides 22 are forced apart, exerting stress on the rod guide material opposite the channel 20. This stress may exceed the elastic limit of the material; consequently, the rod guide may not grip the rod as designed.

The guide is made from a long, solid bar-stock of extruded polymeric material. The bar-stock is first cut to length (which forms the flat surfaces 16). The center-hole 14 is then drilled to form the cylindrical opening for the sucker rod. The center-hole 14 is slightly smaller than the sucker rod on which the rod guide will be mounted. Fabrication further includes machining the axial access, channel or slot 20 with substantially parallel sides 22. Finally, the beveled surface 18 is machine to reduce the fluid friction force generated by movement of the rod guide within the casing. It will be appreciated that the beveled surface 18 may easily be formed when the bar-stock is cut to the desired length for the rod guide and that other machining steps can be performed in another sequence.

Figure 8:
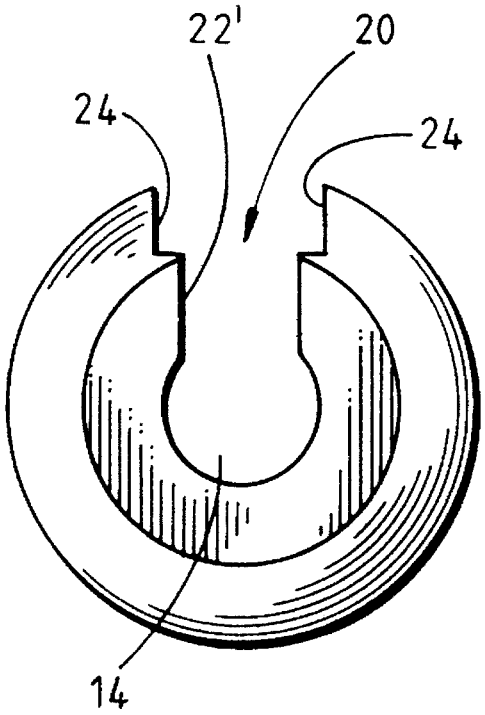
Fig. 8 (PRIOR ART)
FIG. 8 is an end view of another prior art rod guide

FIG. 8 depicts one prior art proposed solution to the problem of stress on the rod guide material during installation. A portion of the access channel 20 has been widened with another channel with parallel sides 24. This permits the rod to penetrate the guide partway with little resistance and to reduce the length of time during installation that the sides 22' and 24 are forced apart by the rod. The sides 22' in the guide shown in FIG. 8 are also machined closer together than the sides 22 of FIG. 7. This is to place more material of the rod guide in intimate contact with the rod once it is installed. Unfortunately, forming the sides 22' even closer together causes them to be forced further apart causing more relaxation of the guide material under stress and losing even more of the grip of the guide on the rod.

Furthermore, the known rod guides depicted in FIGS. 7 and 8 offer an essentially solid aspect for fluid flow about the guide. Fluid, during movement of the sucker rod up and down within the casing, must flow either through the axial access channel 20 or through the clearance between the guide and casing.

Figure 1:
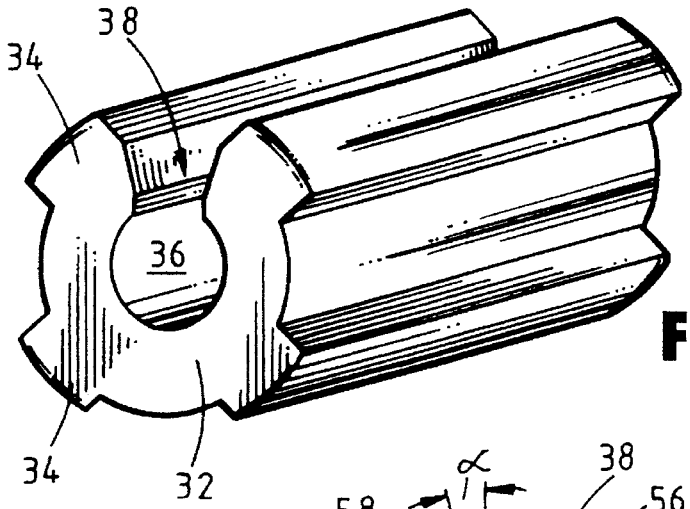
FIG. 1 is a three-dimensional view of the snap-on rod guide of the present invention.
Figure 2:
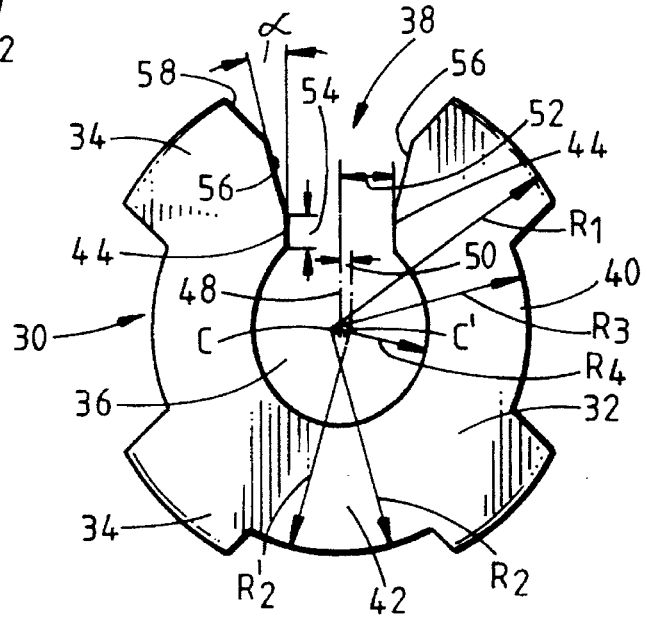
FIG. 2 is a section view of the embodiment of the rod guide of FIG. 1.

These and other problems of the prior art are solved by the present invention, shown in a preferred embodiment in FIGS. 1 and 2. FIG. 2 depicts a section view of a rod guide 30 made in accordance with the teachings of the present invention. The rod guide preferably begins as an extruded length of bar-stock in the shape of the cross-section shown in FIG. 2. Alternatively, the rod guide could also be molded or partially machined to attain the cross section depicted in FIG. 2.

The rod guide 30 comprises a body 32, a plurality of vanes 34, a center-hole 36, and an axial access channel 38. As shown in FIG. 2, the body 32 of the guide is defined, in part, by several radii of curvature $R_1$, $R_2$, $R_2'$, $R_3$ and $R_4$. A center C defines the center of the radii of curvature $R_1$, $R_2$, $R_3$ and $R_4$ and a center C' defines the center of the radius of curvature $R_2'$. The thickness of a side segment 40 of the body 32 is $R_3$–$R_4$ but the thickness of a body segment 4 2 opposite the channel 38 is $R_2$–$R_4$. Since the radius $R_2$ is greater than the radius $R_3$, the body is thicker at the segment 42 opposite the channel than at the side segment 40. This feature of the present invention provides additional body material where it is needed most, at the region of the body that will experience stretch as the rod is forced into the center-hole 36. Note that the body segment 42 also includes $R_2'$–$R_4$ that has the same thickness as $R_2$–$R_4$ immediately adjacent to it.

The feature of having various body segments with different thicknesses permits a new design flexibility that is impossible with the prior art guides depicted in FIGS. 7 and 8. In the present invention, more polymeric material can be placed at the portion of the body designated as 42 for enhanced strength against torsion stress and in the vanes 34 where erodable volume determines the useful lifetime of the guide. Conversely, less material in included at the body segment 40 where less stress is encountered and no erosion occurs. This permits the rod guide designer to tailor the sizes of the vanes and the flow channels to suit a particular application.

Another feature of the present invention depicted in FIG. 2 is referred to herein as the "dual-radius" center-hole 36. The right-hand side of the center-hole, as seen in FIG. 2, has a radius of R4 and has a center of curvature of C. Similarly, the left-hand side of the center-hole 36 has a radius of $R_4$ and has a center of curvature of C'. Thus, when the sucker rod is in place within the center-hole, the body will more firmly grip the rod than if the center-hole were circular, and this gripping action is further enhanced by the thicker body segment 42.

A centerline 48 defines a midpoint between a pair of opposing sides 44. Thus, the sides are a distance apart that is twice a centerline distance 52. It has been found that the distance 5 2 should be a minimum of 50% of the radius $R_4$ to avoid exceeding the elastic limit of the guide material at the segment 42. In a preferred embodiment, for a 2½"×⅞" rod guide, distance 52 measures 0.223" and $R_4$ measures 0.4375", making their ratio about 51%. Also, the centers C and C' are offset from the centerline 48 in the preferred embodiment by 0.050" and the length 54 of the opposing sides 44 measures about 0.100".

To further accommodate the insertion of the rod into the rod guide, the guide includes a pair of slanting faces 56 that are angled from the vertical by an angle α, in a preferred embodiment 15°. The faces 56 form a tapered mouth to receive the rod into the rod guide and this tapered mouth more smoothly and effectively receives the rod than the stepped opening of the prior art guide depicted in FIG. 8. As used herein, the term "tapered mouth" refers to the slanted opening that is gets wider the further it goes from the center-hole 36.

Another feature that distinguishes the embodiment of the present invention depicted in FIGS. 1 and 2 from the prior art guides of FIGS. 7 and 8 is the plurality of vanes 34. Vanes in rod guides are well known in the art but the vanes of the present invention are preferably formed by the extrusion of the bar-stock material from which the guide is made, a feature that has not been known in the art.

Finally with regard to FIG. 1, the ends of the rod guide preferably include a beveled surface, like that shown in FIG. 7, but has been omitted from FIGS. 1 and 2 for ease of depiction.

Figure 3:
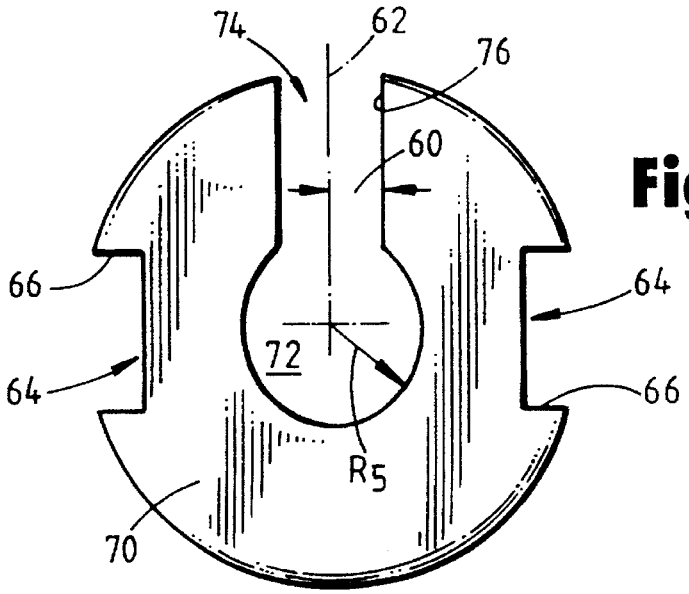
FIG. 3 is a section view of another embodiment of the rod guide of the present invention.

Turning now to FIGS. 3 and 4, a rod guide is depicted that is similar in many respects to the guides depicted in FIGS. 7 and 8, but with several important differences. The rod guide of FIGS. 3 and 4 is machined from solid cylindrical bar-stock, as with the guide of FIGS. 7 and 8. The guide includes a body 70, a center-hole 7 2 and an axial access channel 74. The axial access channel is defined by parallel access sides 76 twice as far apart as a distance 60. The distance 60 is at least 50% of a radius $R_5$ of the center-hole 72. The center-hole in this embodiment is machined from the bar-stock and is therefore circular in cross section. The center-hole could also be extruded with the bar-stock and form the "dual-radius" center-hole previously described. The guide also includes a pair of opposed flow channels 64 which are machined into the bar-stock to reduce the fluid friction of the rod guide against down-hole fluids. The flow channels 64 are defined by parallel opposing sides 66. Finally, another distinction of the embodiment of FIGS. 3 and 4 is the rounded leading edge 78 of the guide, once again to reduce fluid friction of the rod.

FIGS. 5 and 6 depict yet another embodiment of the present invention. This rod guide could be machined from bar-stock or molded as desired. A body 81 includes integral helical thread-type vanes 84 with helical lands 85 therebetween. The guide also includes and center-hole 80, which could be circular in cross-section or dual radius as described before. An axial access channel 8 6 includes tapered sides 87, in this case with no parallel sided channel leading in the center-hole. At its narrowest point, the axial access channel 86 measures a distance 82, which is at least 50% of twice a radius $R_6$. The tapered sides 87 slope at an angle β, preferably 15°. Each end of the guide is also beveled as previously described.

The principles, preferred embodiments, and mode of operation and manufacture of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A rod guide comprising:

a. an elongated polymeric body;

b. vanes projecting from and integral with the body;

c. a center-hole within the body defined by more than one circular radius of curvature; and d. an axial access channel into the center-hole permitting installation of the rod guide onto a sucker rod.

2. A rod guide comprising:

a. an elongated polymeric body;

b. vanes projecting from and integral with the body;

c. lands between some of the vanes;

d. a-center-hole within the body; and e. an axial access channel into the center-hole permitting installation of the rod guide onto a sucker rod;

wherein the body defines a thickness of polymeric material measured from each of said lands to the center-hole and the thickness of the body opposite the axial access channel is greater than another thickness of the body measured from another of said lands to the center-hole.

3. A rod guide comprising:

a. an axial elongated polymeric body;

b. a plurality of vanes projecting radially from and integral with the body;

c. a center-hole co-axial within the body; and d. an axial access channel into the center-hole permitting installation of the rod guide onto a sucker rod, the axial access channel including a tapered mouth tapering from a point outside the body toward the center-hole;

wherein the body, vanes, center-hole and channel are formed as an extruded bar-stock from which the rod guide is cut to a desired length.

4. A field-installable rod guide comprising:

a. an axial elongated polymeric body;

b. a plurality of vanes projecting radially from and integral with the body;

c. a center-hole within the body defined by more than one circular radius of curvature; and d. an axial access channel into the center-hole permitting installation of the rod guide onto a sucker rod, the axial access channel including a tapered mouth tapering from a point outside the body toward the center-hole;

wherein the body defines a thickness of polymeric material measured from each of said lands to the center-hole and the thickness of the body opposite the axial access channel is greater than another thickness of the body measured from another of said lands to the center-hole.

5. The rod guide of claim 4 wherein the body, vanes, center-hole and channel are formed as an extruded bar-stock from which the rod guide is cut to a desired length.

6. A rod guide comprising:

a. an axially oriented extruded solid-cylindrical polymeric body;

b. a co-axial center-hole within the body;

c. an axial access channel into the center-hole permitting installation of the rod guide onto a sucker rod; and d. a flow channel formed on the body to permit fluid flow by the rod guide.

7. The rod guide of claim 6 further comprising a rounded shoulder on the body.

8. The rod guide of claim 6 wherein the access channel defines a width, the center-hole defines a diameter, and the access channel width is at least 50% of the center-hole diameter.

9. A rod guide comprising:

a. an axial elongated polymeric body;

b. a plurality of helical thread-type vanes projecting radially from and integral with the body;

c. a center-hole co-axial within the body; and d. an axial access channel into the center-hole permitting installation of the rod guide onto a sucker rod, the axial access channel including a tapered mouth tapering from a point outside the body toward the center-hole;

wherein the body, center-hole, and channel are formed as an extruded bar-stock from which the rod guide is cut to a desired length.

* * * * *